United States Patent [19]

Anderson

[11] 3,962,893

[45] June 15, 1976

[54] SAFETY SKI LOCK

[75] Inventor: Roger G. Anderson, San Francisco, Calif.

[73] Assignee: The Raymond Lee Organization, Inc., New York, N.Y. ; a part interest

[22] Filed: June 16, 1975

[21] Appl. No.: 587,307

[52] U.S. Cl. ..... 70/19; 70/58

[51] Int. Cl.[2] ..... E05B 73/00

[58] Field of Search ..... 70/58, 18–19, 70/57, 14; 211/605 K; 280/11.37 E, 11.37 A, 11.37 K, 11.37 C

[56] References Cited

UNITED STATES PATENTS

| | | | |
|---|---|---|---|
| 3,091,011 | 5/1963 | Campbell | 70/58 X |
| 3,277,676 | 10/1966 | Poehlmann | 70/58 |
| 3,429,152 | 2/1969 | Whitaker | 70/58 |
| 3,461,696 | 8/1969 | Seka | 70/58 |

*Primary Examiner*—Robert L. Wolfe

*Attorney, Agent, or Firm*—Howard I. Podell

[57] ABSTRACT

A ski lock device for safely clamping a pair of skis in crossed relation to each other to prevent theft. The device includes a pair of clamps that fit about a first ski and over a second ski, with the second ski in crossed relation to the first. Each clamp consists of a pair of slotted members joined together by a threaded joint. A padlock clasp snaps through a hole in each clamp joint to lock the device in place.

3 Claims, 4 Drawing Figures

SAFETY SKI LOCK

SUMMARY OF THE INVENTION

My invention is a ski lock device for safely clamping a pair of skis in crossed relation to each other to prevent theft. The device includes a pair of clamps that fit about a first ski and over a second ski, with the second ski in crossed relation to the first. Each clamp consists of a pair of slotted members joined together by a threaded joint. A padlock clasp snaps through a hole in each clamp joint to lock the device in place.

The device, in the locked position maintains a pair of skis in a crossed relation making an unwieldy package for a thief. The padlock may also be locked about a chain to a post.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
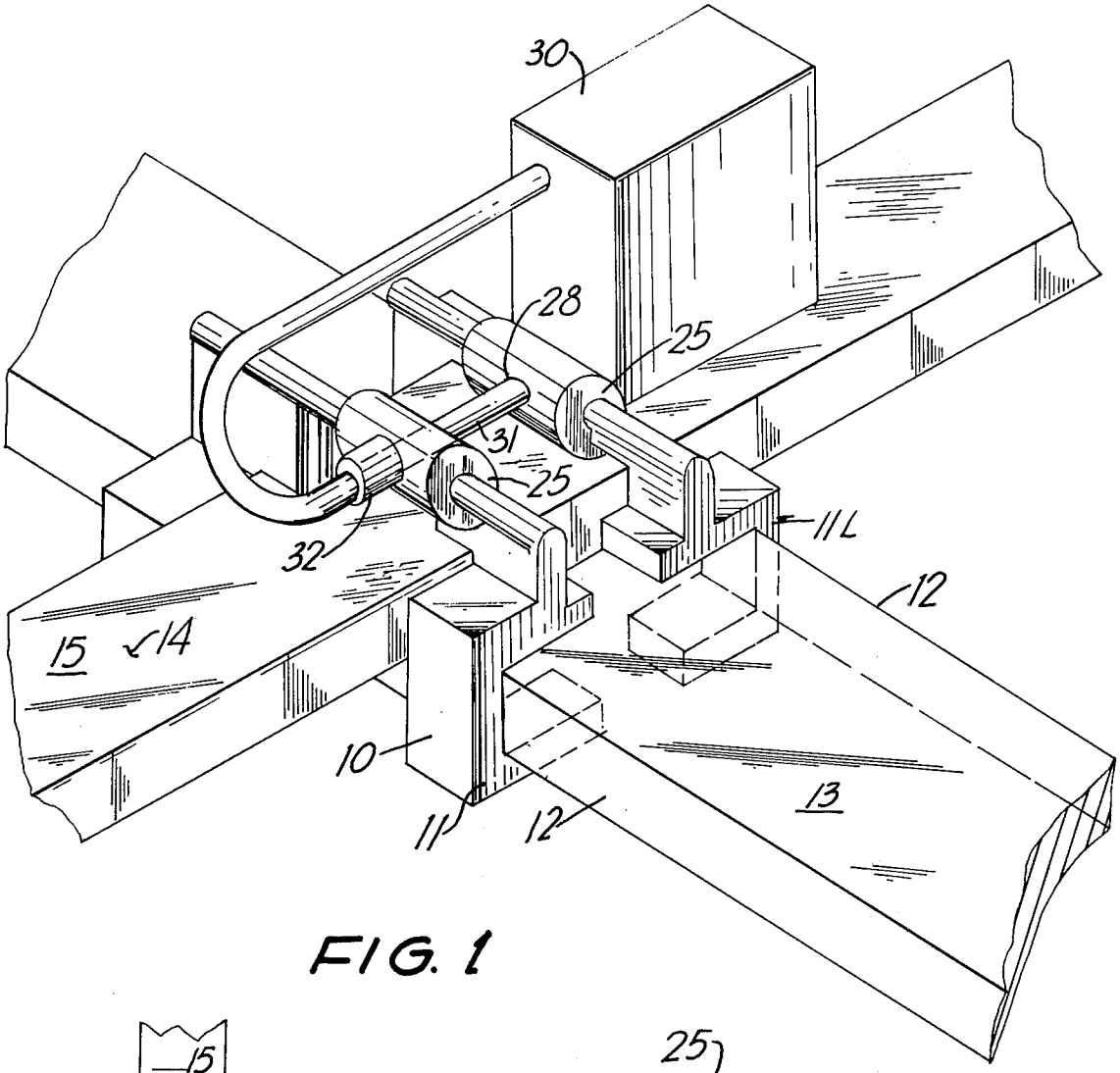
FIG. 1 is a perspective view of the invention in the locked mode.
Figure 2:
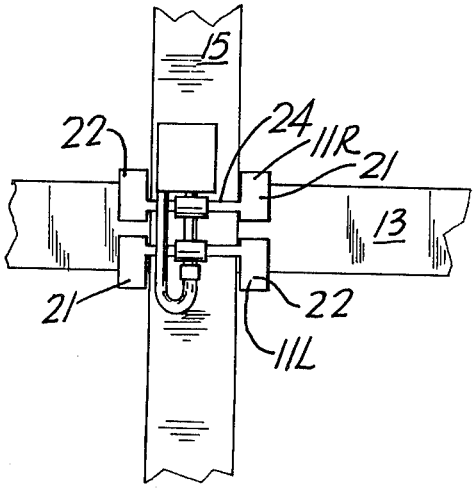
FIG. 2 is a plan view of the invention in the locked mode.
Figure 3:
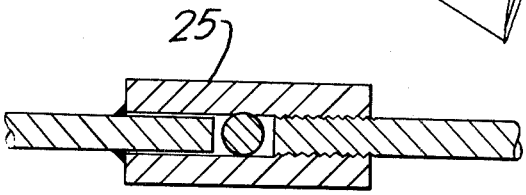
FIG. 3 is a sectional view of a clamp joint of the invention.
Figure 4:
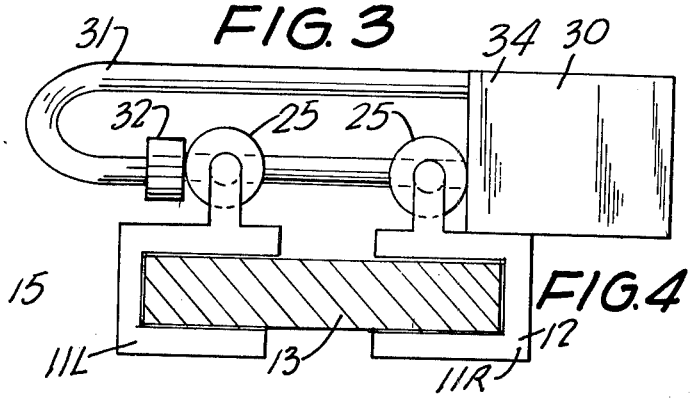
FIG. 4 is a fragmentary sectional view of a pair of skis clamped together by the invention.

Turning now descriptively to the drawings, in which similar reference characters denote similar elements throughout the several views, FIGS. 1–4 illustrate the invention 10 which consists of a pair of clamps 11R and 11L, fitted about the edges 12 of a first ski 13 and over the top surface 14 of a second ski 15 that is mounted in crossed relation to the first ski 13.

Each clamp 11R and 11L is formed in mirror image relation to the other so only clamp 11R will be described. Clamp 11R is formed of two U-shaped members 21 and 22 that each fit over the edge 12 of ski 13 and cover a portion of the top and bottom surfaces of ski 13. The two U-shaped members 21 and 22 are joined together by a male threaded rod 24 fixed to U-shape member 21 that is engaged by a female threaded sleeve 25 welded to a rod 27 fixed to U-shape member 22, with both rods 24, 27 and sleeve 25 oriented to fit above the top surface 14 of a ski 15 resting in crossed relation on a clamped ski 13.

Sleeves 25 of each clamp 11R and 11L are fitted with a through hole 28, the axis of which is oriented in a plane parallel to the surface 14 of a latched ski 15, said holes 25 being of a size to receive the hasp 31 of a padlock 30.

A stop sleeve 32 is welded to the hasp 31 of padlock 30 and located so that in the locked position of the padlock 30 on the device, an edge of stop sleeve 32 contacts the exterior of one sleeve 25 with the body 34 of the padlock contacting the exterior of the other sleeve 25 to prevent said sleeves 25 and attached clamp members 11R and 11L from separating in the locked mode of padlock 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the U.S. is:

1. A device for latching a pair of skis in crossed relation to each other comprising a pair of clamp members, each shaped to fit about one edge of a first ski and over a portion of the top and bottom surfaces of said first ski, each said clamp member formed of two U-shaped sections joined together by a bar, said bar located so as to fit over a second ski resting in crossed relation to a first ski engaged by the clamp member, together with locking means for engaging a pair of clamp members in place.

2. The combination as recited in claim 1 in which the bar joining each of the two U-sections of a clamp member is formed with a threaded joint for adjusting the distance between the two U-sections.

3. The combination as recited in claim 2 in which a padlock hasp fits through a hole in the female threaded member of the threaded joint of each clamp member bar.

* * * * *